United States Patent [19]

Dobbins

[11] 4,256,303

[45] Mar. 17, 1981

[54] TENNIS PRACTICE DEVICE

[76] Inventor: Edward C. Dobbins, P.O. Box 180, Black's Harbour, New Brunswick, Canada

[21] Appl. No.: 628,053

[22] Filed: Nov. 3, 1975

[51] Int. Cl.[3] ..... A63B 69/40

[52] U.S. Cl. ..... 273/29 A; 124/7; 124/34; 124/36

[58] Field of Search ..... 273/29 A, 26 D; 124/17, 124/35, 36, 40, 41 R, 34, 16, 74

[56] References Cited

U.S. PATENT DOCUMENTS

| | | | |
|---|---|---|---|
| 1,825,882 | 10/1931 | Mauney | 273/26 D |
| 2,147,705 | 2/1939 | Hunter | 273/26 R |
| 3,760,787 | 9/1973 | Kahelin | 273/26 D X |
| 3,777,733 | 12/1973 | Mitchell | 124/16 |
| 3,841,294 | 10/1974 | McGill | 124/16 |

FOREIGN PATENT DOCUMENTS 6134 of 1890 United Kingdom ..... 273/29 A

*Primary Examiner*—Richard C. Pinkham
*Assistant Examiner*—T. Brown
*Attorney, Agent, or Firm*—Cesari & McKenna

[57] ABSTRACT

A tennis practice device for propelling balls to a player. The player cocks a hammer and sets a time delay mechanism from his receiving position which is remote from the hammer. After a fixed period of time, during which the player positions himself, the delay mechanism releases the hammer to propel the ball toward the player. The time delay mechanism may comprise a tiltable normally inclined channel which guides a ball. When the delay mechanism is set, the channel tilts to a release position wherein the ball rolls down the channel and trips a latch to release the hammer.

3 Claims, 3 Drawing Figures

TENNIS PRACTICE DEVICE

BACKGROUND OF THE INVENTION

The present invention relates generally to a device for propelling tennis balls or similar projectiles and, more specifically, to improved actuation and time delay mechanisms for use therewith.

Apparatus for propelling balls or targets for use in various sports are well known. Such launching devices are commonly powered by a motor and periodically throw balls, targets or the like. Typically they comprise a throwing arm which rotates about a shaft or a hammer which strikes the projectile. These motorized launchers are necessarily expensive to purchase and often expensive to maintain.

Other launching devices are foot actuated by a treadle which is linked to a throwing arm. Such foot actuated devices, however, usually include a direct linkage between the treadle and the throwing mechanism. Consequently, there is no time delay between the time when the player actuates the device and when the ball or target is thrown. As a result, the player has no time to properly prepare himself for reacting to the thrown object.

An actuation mechanism including a delay mechanism is known, but only in connection with a batting trainer. The batter presses the ball down on a plunger to set it to a cocked position. The player then momentarily steps on and flattens a resilient loop. As the loop gradually resumes its original shape, the player sets himself to bat the ball. When the loop resumes its unstressed form, it releases the plunger which propels the ball upwards for the player to hit. This prior device is not suitable to practice sports, such as tennis, in which the player would like to remain fairly distant from the throwing mechanism.

SUMMARY

Consequently, it is an object of the present invention to provide a tennis practice device for throwing balls which is actuated by a player from a location at which he can properly react to the thrown balls.

Another object of the invention is to provide a time delay mechanism for use with such a tennis practice device.

A further object of the invention is to provide a tennis practice device of this general type having a single, simple mechanism for actuating the device and setting a time delay.

In consideration of the above objectives, I provide a tennis practice device for projecting balls along a selected trajectory. To actuate the device, the player steps on a pedal to cock a hammer and set a time delay mechanism. The delay mechanism releases the hammer to propel the ball to the player a fixed period of time after the device is actuated. The delay period is necessary to the invention to enable the player to position himself properly to hit the ball.

The time delay mechanism may compromise a tiltable, normally inclined channel having a weighted ball therein. Actuating the pedal momentarily tilts the channel placing the ball at the upper end of the channel, whereupon the ball rolls down the channel and trips a latching mechanism to release the hammer from its cocked position. The released hammer strikes the tennis ball to project it toward the player.

The device may also include netting for receiving the ball after it is hit by the player and for channeling the ball back to its original position.

DESCRIPTION OF THE PREFERRED EMBODIMENT

Figure 1:
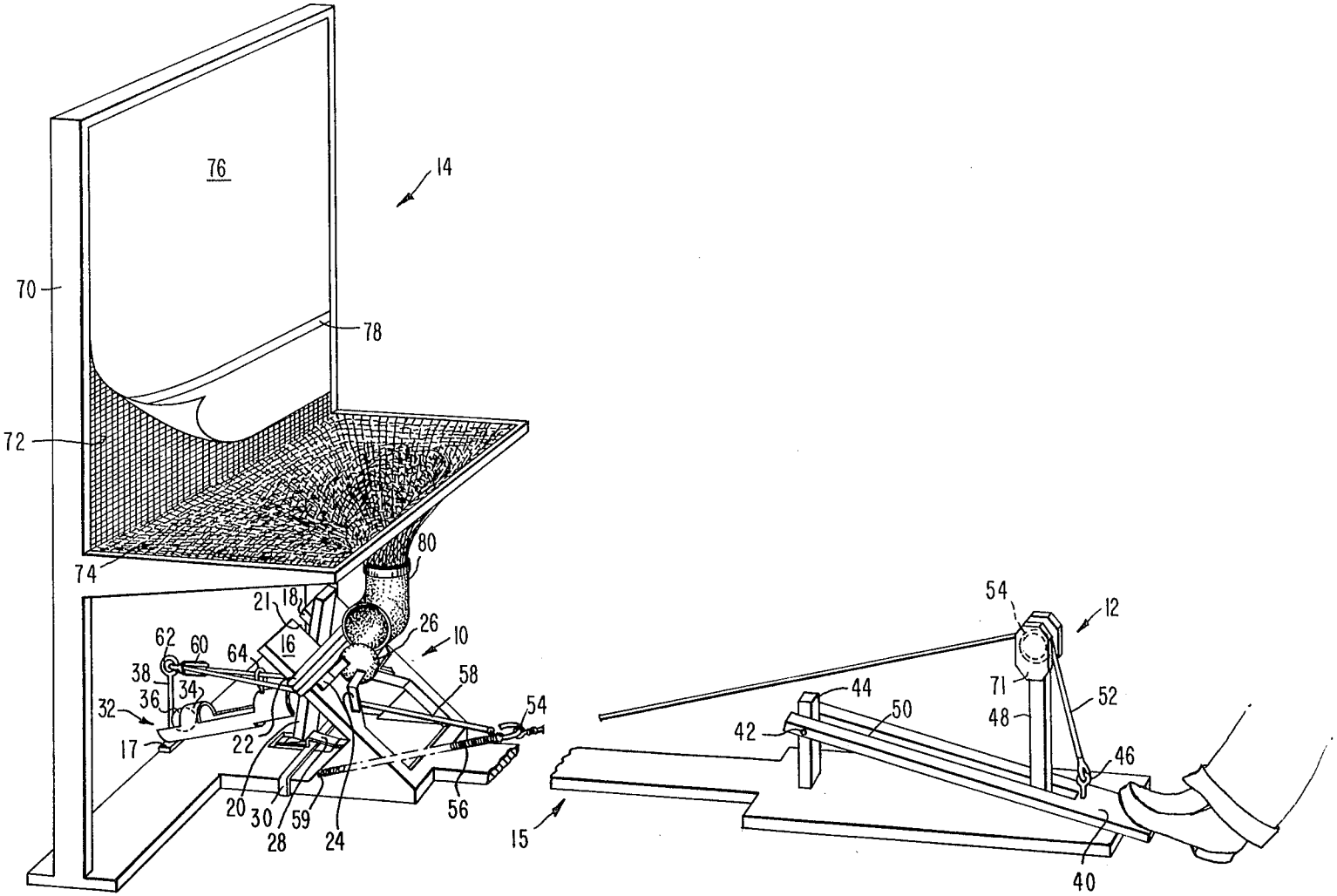
FIG. 1 is a perspective view of the tennis practice device.

FIG. 1 is an overall view of the tennis practice device. In general, it includes a propulsion mechanism 10, a pedal assembly 12 and a receiving assembly 14 mounted on a base 15. In use, the player actuates the pedal assembly 12 from his receiving position and then sets himself to receive the ball. The pedal assembly 12 sets the propulsion assembly which, after a short delay, propels the ball to the player. The player hits the ball with his racquet as he would in a tennis game and returns the ball to the receiving assembly 14 which guides the ball back to the propulsion assembly 10.

The propulsion assembly 10 includes a flat, inclined face plate 16 having a slot 18, the plate 16 being mounted to the base 15. An elongated hammer 20 is hinged at 21 near its upper end to the rear of face plate 16, its lower end being free to swing through the slot 18. An elastic band 22 is wrapped around the plate 16 and the hammer 20 to urge the free, lower end of hammer 20 into the slot 18. Three L-shaped stops 24 support a tennis ball 26 on the plate 16 over the slot 18, the slot, of course, being narrower than the ball.

Figure 2:
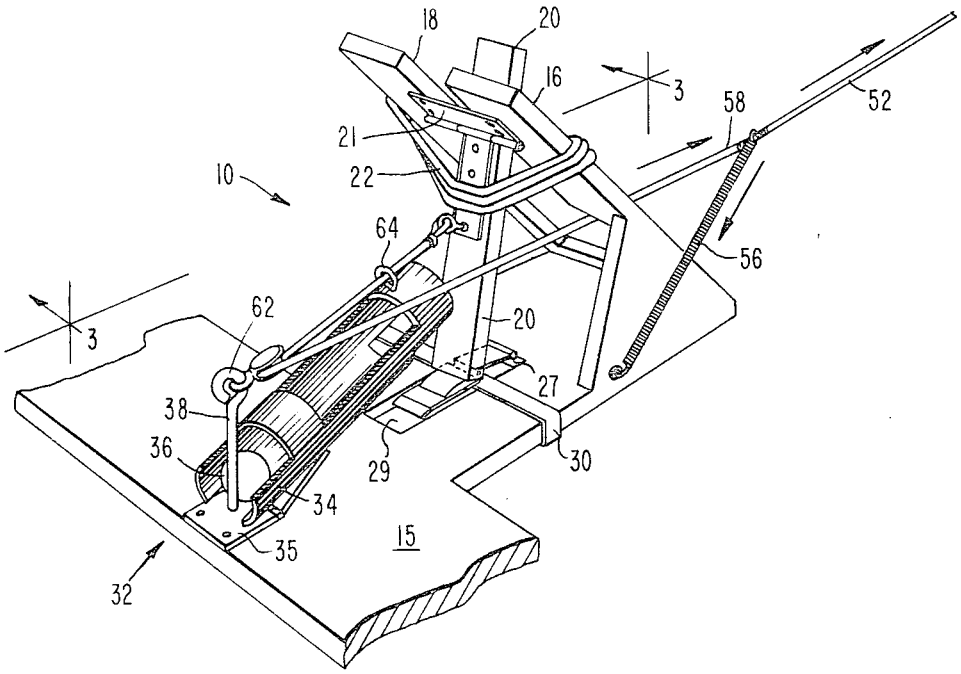
FIG. 2 is a perspective view of the device's propulsion mechanism in its set position.

The propulsion mechanism 10 is shown in FIGS. 1 and 2 in its cocked position with the hammer 20 drawn back in opposition to the bias of elastic band 22. The hammer 20 is held in that position by a latch 28. As best seen in FIG. 2, the latch is hinged at 27 in a recess 29 in base 15 and biased into engagement with the lower end of hammer 20 by a second elastic band 30. A delay mechanism indicated generally at 32 is also shown in its cocked position in these figures. The delay mechanism includes a channel 34 which is pivotally mounted to the base 15 by a hinge 35. The channel is tilted so that a weighted ball 36 in the channel rests against a stop 38 at the end of the channel remote from the hammer.

The propulsion mechanism 10 is cocked by the pedal assembly 12 which includes a pedal 40 mounted at one end by a pivot 42 to a post 44 extending up from base 15. An eye 46 is attached to the pedal 40 and a post 48 extends up from base 15 through a slot 50 in the pedal.

A cable 52 having one end attached to the eye 46 passes over a pulley 54 mounted on the top of post 48. The cable 52 leads to a ring 54 which is also connected to corresponding ends of an elastic cord 56 and a cable 58. The opposite end of cord 56 is attached to the base 15 by a pin 59, while cable 58 passes around a pulley 60 which is attached to an eye 62 at the end of stop 38. From there, the cable 58 extends through an eye 64 attached to the end of channel 34 adjacent hammer 20 and connects to the hammer 20.

Still referring to FIGS. 1 and 2, the elastic cord 56 tensions the cable 52 so that the pedal 40 is normally pulled up against a stop 71 at the underside of the pulley 54. To actuate the device, the player steps on the end of the pedal 40 which, via cable 52, pulls cable 58 taut. The taut cable 58 tilts the channel 34 upwards so that the ball 36 rolls against the stop 38. The cable 58 also retracts hammer 20 until it is engaged by latch 28.

Figure 3:
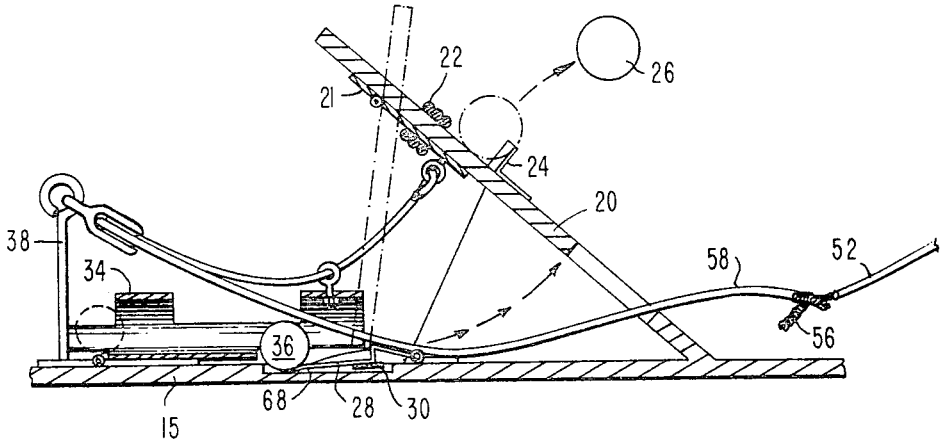
FIG. 3 is a similar view of the propulsion mechanism in its released position.

When the pedal 40 is released, cable 56 becomes slack as shown in FIG. 3. Resultantly, the channel 34 drops down to its normal inclined position so that the ball 36 rolls down the channel 38 and engages a lip 68 of the latch 28 and trips the latch. The latch 28 releases the end of hammer 20 so that the hammer swings forward from its dotted line position in FIG. 3 to its solid line position in that figure, and strikes the tennis ball 26 thereby propelling the ball toward the player. The time required for the weighted ball 36 to roll the length of channel 34 enables the player to position himself to hit the ball 26.

As shown in FIG. 1, the receiving portion 14 of the tennis practice device includes a frame 70 with netting 72 strung vertically to form a backstop and netting 74 strung to form a funnel. A sheet 76 of nylon or similar material is hung over the netting 72 and a horizontal stripe 78 may be painted on the sheet to simulate the top of a tennis net.

The tennis ball 26 which is hit by the player is returned to the backstop net 72. The damping characteristics of that net cause the ball 26 to drop into the funnel netting 74 which leads it through an L-shaped pipe 80 secured at the mouth of netting 74 and back to its ready position on plate 16. Thus, the ball 26 is again in position to be propelled to the player.

It will be clear to those skilled in the art that various changes may be made from the foregoing without departing from either the spirit or the scope of the invention and it is intended that such changes be encompassed herein, the scope of the invention being defined particularly in the attached claims.

I claim:

1. A tennis practice device for propelling a tennis ball to a player at a receiving location to simulate an opponent's returning a tennis ball during normal tennis playing, said practice device comprising:

A. a hammer mounted for movement between a cocked position and a ball-striking position, B. means urging said hammer from the cocked position to the ball-striking position, C. means for retaining a tennis ball at the ball-striking position whereby when said hammer moves from the cocked position to the ball-striking position it propells a tennis ball toward said receiving location, D. a latch for holding the hammer in the cocked position, E. delay means settable to begin a delay period and operative at the end of the delay period to trip the latch, thereby releasing the hammer to move to the ball-striking position, said delay means comprising, (1) a channel having a first end and a second end tiltable between a set position and a normal release position, (2) a ball disposed in said channel, (3) said ball in said channel being disposed toward said first end of said channel when the channel is in the set position and rolling toward the other end of said channel when the channel is in the release position, thereby to engage and trip the latch to release the hammer, and, F. setting means proximate to the receiving location and connected to said hammer so that, when actuated by a player, it moves the hammer to the cocked position and moves the channel to the set position and when released by a player it permits the channel to tilt to the release position.

2. A tennis practice device as defined in claim 1 wherein the setting means include a tensioned cord which helps to tilt the channel to its set position and also moves the hammer to the cocked position.

3. A tennis practice device as defined in claim 1 and further including receiving means for intercepting a tennis ball after a tennis ball is hit by a player and returning a tennis ball to said retaining means.

* * * * *